US008998153B2

(12) United States Patent
Lucas

(10) Patent No.: US 8,998,153 B2
(45) Date of Patent: Apr. 7, 2015

(54) WRIST SUPPORT

(76) Inventor: Michael Ray Lucas, Costa Mesa, CA (US)

( * ) Notice: Subject to any disclaimer, the term of this patent is extended or adjusted under 35 U.S.C. 154(b) by 0 days.

(21) Appl. No.: 13/193,606

(22) Filed: Jul. 29, 2011

(65) Prior Publication Data

US 2012/0305715 A1 Dec. 6, 2012

Related U.S. Application Data

(60) Provisional application No. 61/407,447, filed on Oct. 28, 2010.

(51) Int. Cl.
*B68G 5/00* (2006.01)
*A47B 21/03* (2006.01)

(52) U.S. Cl.
CPC ..... *A47B 21/0371* (2013.01)

(58) Field of Classification Search
USPC ..... 248/118; 602/20, 64; 2/16, 161.1
See application file for complete search history.

(56) References Cited

U.S. PATENT DOCUMENTS 1,728,679 A * 9/1929 Hansard ..... 473/213
2,709,257 A * 5/1955 McKinney ..... 2/16
3,062,546 A * 11/1962 Horton et al. ..... 473/61
3,178,724 A * 4/1965 Perschke ..... 2/16
3,238,939 A * 3/1966 Stubbs ..... 602/64
3,606,343 A * 9/1971 Lemon ..... 473/62
3,707,730 A * 1/1973 Slider ..... 2/161.1
3,726,525 A * 4/1973 Jackson ..... 473/61
3,880,426 A * 4/1975 Morse ..... 473/61
4,121,360 A * 10/1978 Vlerebome ..... 40/586
4,176,839 A * 12/1979 Pinkus ..... 602/64
4,632,105 A * 12/1986 Barlow ..... 602/64
4,809,366 A * 3/1989 Pratt ..... 2/170
4,813,406 A * 3/1989 Ogle, II ..... 602/22
D300,948 S * 5/1989 Harris et al. ..... D24/190
4,854,310 A * 8/1989 Lee ..... 602/21
4,941,460 A * 7/1990 Working ..... 602/21
4,953,568 A * 9/1990 Theisler ..... 128/878
5,064,198 A * 11/1991 Szabo ..... 473/213
5,082,156 A * 1/1992 Braun ..... 224/220
5,101,812 A * 4/1992 Wang ..... 602/22
5,135,217 A * 8/1992 Swain ..... 473/450
5,188,356 A * 2/1993 Furr et al. ..... 473/450
5,193,771 A * 3/1993 Hassel et al. ..... 248/118
5,466,215 A * 11/1995 Lair et al. ..... 602/21
5,527,040 A * 6/1996 Stanley et al. ..... 473/213
5,685,787 A * 11/1997 Kogut ..... 473/409
5,746,707 A * 5/1998 Eck ..... 602/21
5,916,187 A * 6/1999 Brill ..... 602/21
5,924,136 A * 7/1999 Ogean ..... 2/159
6,039,292 A * 3/2000 Danzyger et al. ..... 248/118.5
6,094,747 A * 8/2000 Malick ..... 2/159
6,102,880 A * 8/2000 Nelson et al. ..... 602/21
6,120,472 A * 9/2000 Singer, Jr. ..... 602/64
6,341,376 B1 * 1/2002 Smerdon, Jr. ..... 2/16
6,360,684 B1 * 3/2002 Quaglia ..... 116/222

(Continued)

*Primary Examiner* — Terrell McKinnon
*Assistant Examiner* — Daniel Breslin
(74) *Attorney, Agent, or Firm* — One3 IP Management, P.C.; Jeromye V. Sartain

(57) ABSTRACT

The limb supporting system is an on the go wrist support pad that is designed to give the user cushion and support while free you move from PC to laptop, keyboard, gaming and mousing without pain and discomfort often associated with such movements. Made from soft stretchable elastic that conforms to any size wrist giving you total comfort during repetitive computer use.

10 Claims, 20 Drawing Sheets

(56) References Cited

U.S. PATENT DOCUMENTS

| | | | | |
|---|---|---|---|---|
| 6,513,685 | B1 * | 2/2003 | Tzoubris | 223/111 |
| 6,520,925 | B1 * | 2/2003 | Thibodo, Jr. | 602/22 |
| 6,547,193 | B2 * | 4/2003 | Money et al. | 248/118 |
| 6,834,397 | B1 * | 12/2004 | Murphy | 2/161.1 |
| 7,037,286 | B1 * | 5/2006 | Reinhardt | 602/21 |
| D528,263 | S * | 9/2006 | Van Trojen | D2/610 |
| D558,883 | S * | 1/2008 | Ortiz | D24/190 |
| 8,060,948 | B2 * | 11/2011 | Pesic | 2/161.5 |
| 8,216,169 | B2 * | 7/2012 | Koby et al. | 602/21 |
| 8,480,502 | B2 * | 7/2013 | Korte | 473/62 |
| 2006/0276735 | A1 * | 12/2006 | Phelen et al. | 602/21 |
| 2010/0022930 | A1 * | 1/2010 | Koby et al. | 602/21 |

* cited by examiner

Wristrictor - wrist support pad
front view/outer shell

Fig. 3 - Wristrictor wristband
Fig. 4 - Tab closure -velcro male (hook)
Fig. 5 - Thumbstrap
Fig. 6 - Tab fastener -velcro female (loop)
Fig. 7 - Polyurethane cushion beads
Fig. 8 - Cotton cloth bead bag
Fig. 9 - Wristrictor Logo brand tag Wristrictor - wrist support pad back view/inside Fig. 3 - Wristrictor wristband
Fig. 4 - Tab closure -velcro male (hook)
Fig. 5 - Thumbstrap
Fig. 6 - Tab fastener (Not Visible front back view; see Fig. 1)
Fig. 7 - Polyurethane beads
Fig. 8 - Cotton cloth bead bag
Fig. 9 - Wristrictor Logo brand tag (Not Visible from back view; see Fig. 1)

Fig. 3

Wristristor's "Neoprene" wristband

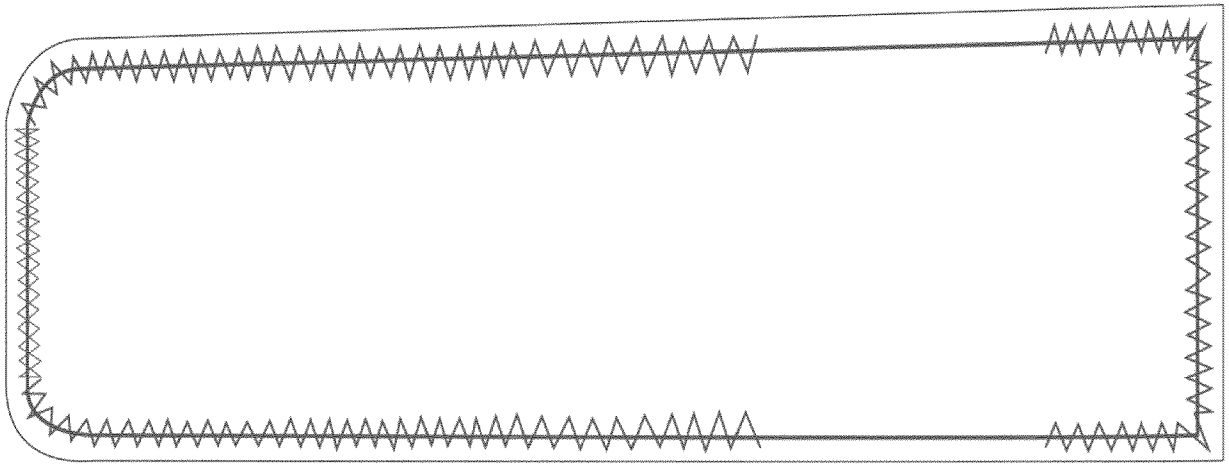

8" Inches Long 3" Inches In Width

Description: Fig. 3 Neoprene wristband
Wristrictor's neo prene wristband wraps around your wrist for support and comfort. The wristband is the main piece of material.

Specification: Stretchable Neoprene - a closed cell foam, and or specialty foam, water resistant extremely versatile synthetic rubber. 100% washable.

Velcro "Tab fastener" (hook)male 2.25 Inches long x 2.00 Inches wide

Description: Fig. 4 Tab fastener (hook) male Tab fastener (hook) male used to secure a tight proper fit. Fig. 4 attaches by being sewed to Fig. 3 to complete the secure attachment

Specification: Velcro tab fabric made of nylon/polyester (hook) or male will attach to Fig. 6 the female (loop)- to secure closure and proper fit Fig. 5 Thumb Strap

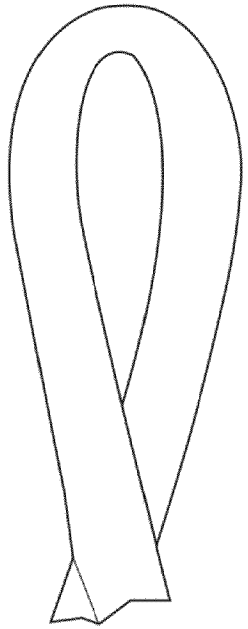

5.0 Inches Long & 1.50 Inches Wide Elastic Strip

Description: Fig. 5 Thumb strap The thump strap attaches to Fig. 3. Its use is to help guide the wristrictor around your wrist with ease. After secure thumb strap is optional during use . It is needed to put wristristor on with out struggle.

Specification: Synthetic Elastic Strip is the guide and support for the thumb. Fig. 5. Sewed as shown above folded one end over another to create a signature loop to adjust when you change wrist the signature loop will flip fitting properly both thumbs without a twist.

Fig. 6

Velcro Tab fastener (loop) female

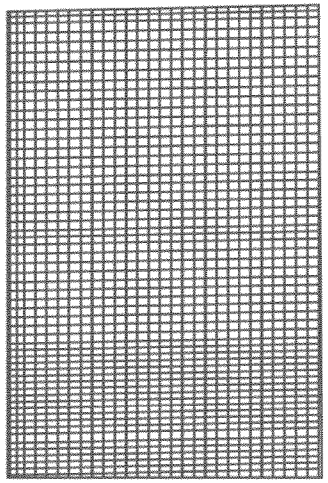

2" Inches Wide x 3" inches long

Description: Fig. 6 Tab Fastener (loop)female

Purpose to secure the fit of the wristrictor around your wrist. Once velcro hoop and loop attach device is wrapped around the wrist. Using velcro makes it easy to adjust with its tear away function

Specification: Velcro fabric made of nylon/polyester -Fig. 6 Tab fastener (loop) female is sewed flat to Fig. 3 Sewed horizontal as shown above to maximize the adjustable function. Fig. 6. Tab (loop) female will attach to Fig. 4 tab (hook) male to secure closure and proper fit.

Fig. 7

Poly polypropylene beads

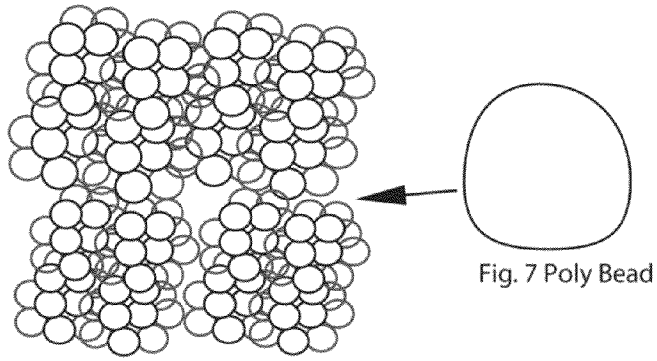

Poly polypropylene beads (1/16)

Description: Fig. 7 Poly Polyurethane beads Polyurethane beads are safe earth friendly used in small amounts (7 oz. to 8 oz) enclosed into Fig. 8 cotton blend lightweight fabric. The poly beads are the mainsupport levage to help the wrist balance pressure. The same way a support strip or mouse pad would do.

Specification: Poly beads are used as a buffer for under the wrist to elevate it which will allevate pressure as the wrist will remain balance between it and the device. Fig. 7 Poly-polypropylene beads are weighed the same at ( 7cz to 8 oz ) sewed into Fig. 8 Cotton blendcloth lightweight fabric bead bag houses beads so that they can distribute where elevation is needed.

Fig. 8

Cotton blend fabric bead bag

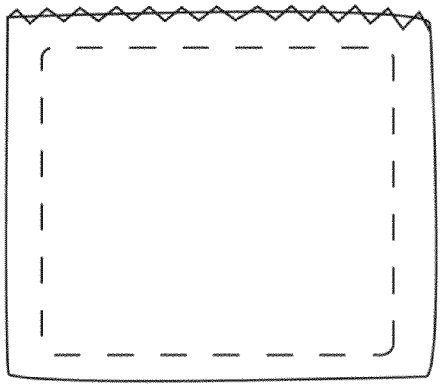

Fig. 8 Cotton blend fabric 2.25 x 2.25

Description: Fig. 8 Cotton blend bead fabric bag
Cotton bead bag houses the (pu) poly beads (Fig. 7) by keeping them in a central area to eleavate the wrist. The bead bag filled with poly beads fills like a pillow and it in inserted into Fig. 3-wristband.

Specification: 100% Cotton blend fabric is sewed at all ends to keep the poly beads from moving around and losing their function. Fig. 7 Poly polyurethane beads are filled in to the bead bag weighing (7 oz - 8 oz ). The cotton fabric bag is lightweight ,washable .

Fig. 9

Logo Wordmark Tag

WRISTRICTOR

Logo label .50" wide Cotton blend broadcloth lightweight fabric 2.25" long

Description: Fig. 9 Nylon Logo Tag Label
States name and logo for Wristrictor Branding. Logo tag will show on the side of the wrist. Logo tag is washable and light. Primarly function is branding Wristrictor ™

Specification: Logo tag (Fig. 9) is sewed flat onto (Fig. 3) wristband on all four sides to secure application. Label is lightweight and washable .50 Inches wide and 2.25 long.

Fig. 9A

WRISTRICTOR

Wristrictor - wrist support pad
front view/outer shell (clean version)

Wristrictor- Product Instructions

Fig. 11

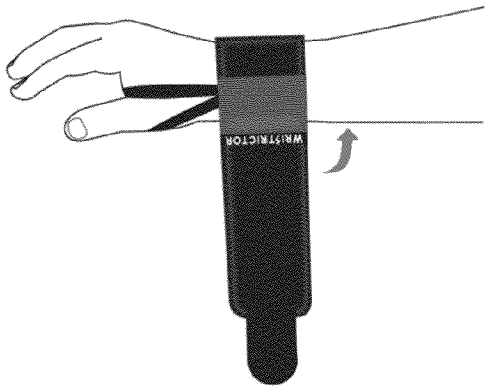

Use thumb strap to guide wristrictor around your wrist. Padded area needs to be under wrist as you wrap to increase pressure for support as needed.

Fig. 12

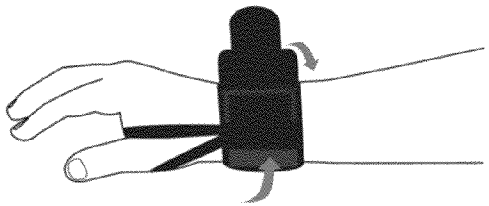

Wrap wristrictor securely around your wrist, and adjust strap to your comfort level.The wristrictor will conform to your wrist and allow support and comfort to go with you.

Fig. 13

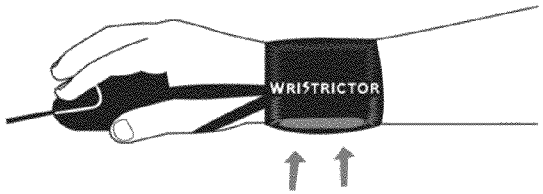

The cushion beads elevates the wrist to alleviate pressure and give you support and comfort no matter where you go. (thumb strap is optional)

WRIST SUPPORT

This application emanates from a previous provisional filing: application No. 61/407,447 previously entitled "The Wrist support-wrist support pad", dated Oct. 28, 2010.

FIELD OF THE INVENTION

The present invention relates generally to injury prevention and pain reduction aids. More particularly, the invention relates to wrist supports for computer users and the like. Specifically, the invention relates to a wrist support, which is worn on an individual's person.

BACKGROUND OF THE INVENTION

One aspect of modern life is the increasing use of computers in the home and in the office. It is common for people to spend long periods of time entering information into a computer via a keyboard and mouse or surfing the Internet looking for information. At a typical computer workstation, the keyboard is located near the front edge of the desk or other work surface and a mouse is ordinarily positioned adjacent the keyboard as an auxiliary input device to move a cursor around a computer screen. Traditionally, the user sits in front of the keyboard and mouse as the computer is utilized for work, play or for gathering general information. While a user may often use the computer for hours at a time the user may also use the computer intermittently to perform specific tasks coming to and from the computer many times throughout the day.

The computer mouse mentioned above is a typical device used to aid the processing of information in a computer. Computer users typically use a mouse in combination with the computer keyboard. The computer mouse is normally operated on a flat work top surface that provides both the necessary space to maneuver the mouse and, in the case of a tracking ball type mouse, provides sufficient friction so that the tracking ball rotates appropriately as the mouse is navigated across the operating surface.

One of the problems associated with the use of a keyboard and mouse is the need to comfortably position the user's wrist and arm during operation. As the user positions their hands for typing on the keyboard or for utilizing the mouse, it is common that either their wrist or a portion of their forearm will end up resting on the sharp edge of the desk. Similarly, in the case of a laptop computer that incorporates a touchpad the user's wrist or forearm will tend to rest on the edge of the computer keyboard. This causes the wrist to be held at an awkward angle and, in combination with the pressure exerted on the wrist or forearm by the edge of the desk or laptop surface, together with the extensive periods of time the computer may be used, may lead to repetitive stress injuries to the wrist and forearm such as carpal tunnel syndrome. Although it may be possible to smooth or round the edge of the desk, this normally requires significant skill and would substantially reduce the aesthetic appearance of the furniture on which the computer is placed.

Various devices have been provided in the prior art in an attempt to address this growing problem. While all of these devices are available on the market, existing medical and ergonomic literature does not address the kinesiology of motion in the operation of computer input devices that apply muscular skeletal forces in multiple directions and often with the result of opposing physiological forces. For example, lifting the wrist causes contraction on the top of the wrist and elongation on the underside thereof. Repetitive compound motion of the hand and the wrist of the user of a computer input device, such as a mouse, can cause muscular skeletal tension. In the case of operators of a computer mouse specifically the index finger and associated muscles and tendons are holding the mouse button, while at the same time, the hand, thumb and other fingers are holding and causing the mouse to move. This latter motion also impacts the wrist and forearm that must twist on an axis to maintain pressure on the mouse and complete the desired action. A number of products exist, such as devices, which are strapped to the user's wrist. While said strap-on wrist supports are presumably adequate for the athletic uses they re intended, they remain ineffective in the slight and sometimes tedious movements required in computer mouse manipulation.

Devices have included wrist supports that are strapped to the user's wrist and forearm, keyboard trays that incorporate a wrist rest, gel-filled or bead-filled pillows that are positioned adjacent the keyboard or mouse, and a concave arm rest that can clamp onto the edge of a desk and provide a resting place for the user's arm. A number of these previously known devices tend to shift position relative to the keyboard of mouse over time and thereby exacerbate the problem.

The Wrist support will be the first on-the-go wrist support pad made unlike your common mouse pad that remains at your desk. The Wrist support is the first real on-the-go wrist support pad that allows support and comfort to go with you. The development and idea came when I heard my mother suffering from a bad case of CTS known as Carpal Tunnel Syndrome. So, after some researching about CTS I discovered that it is very common among many people, especially those who use computers, laptops, gaming, etc. I reflected on my days as a personal trainer when my clients and I needed to wrap our wrists for support during workouts. Now that I work on computers for a long period of time, I noticed that my wrist began to hurt so I wrapped my wrist as I did when I trained and it helped, also while using my desk pad to elevate my wrist. Then the idea came to me . . . is there a wrist support pad out there of this nature? I went to the web and found a million and one mouse pads and funny looking gloves, which I tried and had to return due to its ineffectiveness. I then began to design my idea of a wrist support pad that stays with you giving your wrist the cushion and support it needs during repetitive computer use. Thus, "The Wrist Support"—support your wrist.

SUMMARY OF THE INVENTION

The Wrist support is an on-the-go wrist support pad that is designed to give you cushion and support while you move from PC to laptop, keyboard, gaming and mousing. Made from soft stretchable elastic that conforms to any size wrist, it gives you total comfort during repetitive computer use.

The current wrist support is a wrist support pad that cushions and supports the wrist during long repetitive hours on a PC, laptop, keyboard, gaming, or mousing. The pad is filled with earth-friendly cushion beads that elevate the wrist to alleviate pressure. The soft stretchable elastic will conform to your wrist giving added wrist support. The Wrist support is very comfortable, and has easy care instructions; hand wash cold and lay flat to dry. JUST TRY IT! The Wrist support-the first on-the-go wrist support pad.

My invention elevates your wrist to maintain support and comfort during repetitive use.

The Wrist support is an on-the-go wrist support pad that is designed to give you cushion and support while you move from PC to laptop, keyboard, gaming and mousing. Made from soft stretchable elastic that conforms to any size wrist it gives you total comfort during repetitive computer use.

BRIEF DESCRIPTION OF THE DRAWINGS

The accompanying drawings illustrate aspects of the present invention. In such drawings there are shown side schematic views of an exemplary embodiment of the Wrist support in use in three operational states, labeled as FIGS. 11-13, and particularly there are provided, in two different versions, with and without text, drawings as follows:

FIG. 3 is a front schematic view of a wristband thereof;

FIG. 5 is a front schematic view of a thumb strap thereof;

FIG. 6 is a front schematic view of a tab fastener female loop portion thereof;

FIG. 7 is a schematic view of polypropylene beads thereof;

FIG. 8 is a schematic view of a bead bag thereof;

FIG. 9 is a schematic view of a tag thereof;

FIG. 9A is a schematic view of a tag thereof, now without text;

FIG. 11 is side schematic view of an exemplary embodiment of the Wrist support invention in a first operational state;

FIG. 12 is a side schematic view thereof in a second operational state;

FIG. 13 is a side schematic view thereof in a third operational state;

Figure 1:
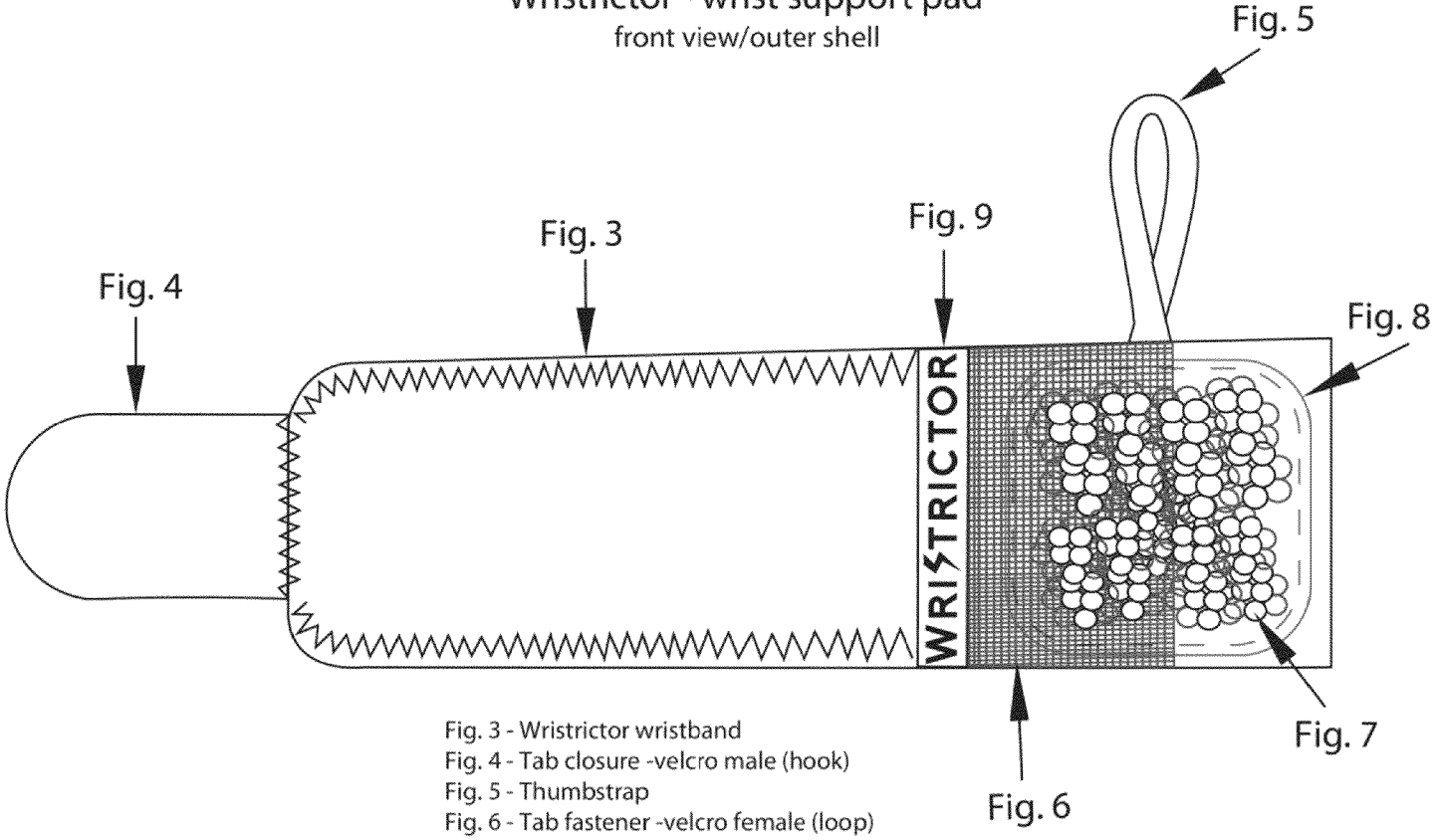
FIG. 1 is a front schematic view, partially in section, of an exemplary embodiment of the Wrist support invention.
Figure 2:
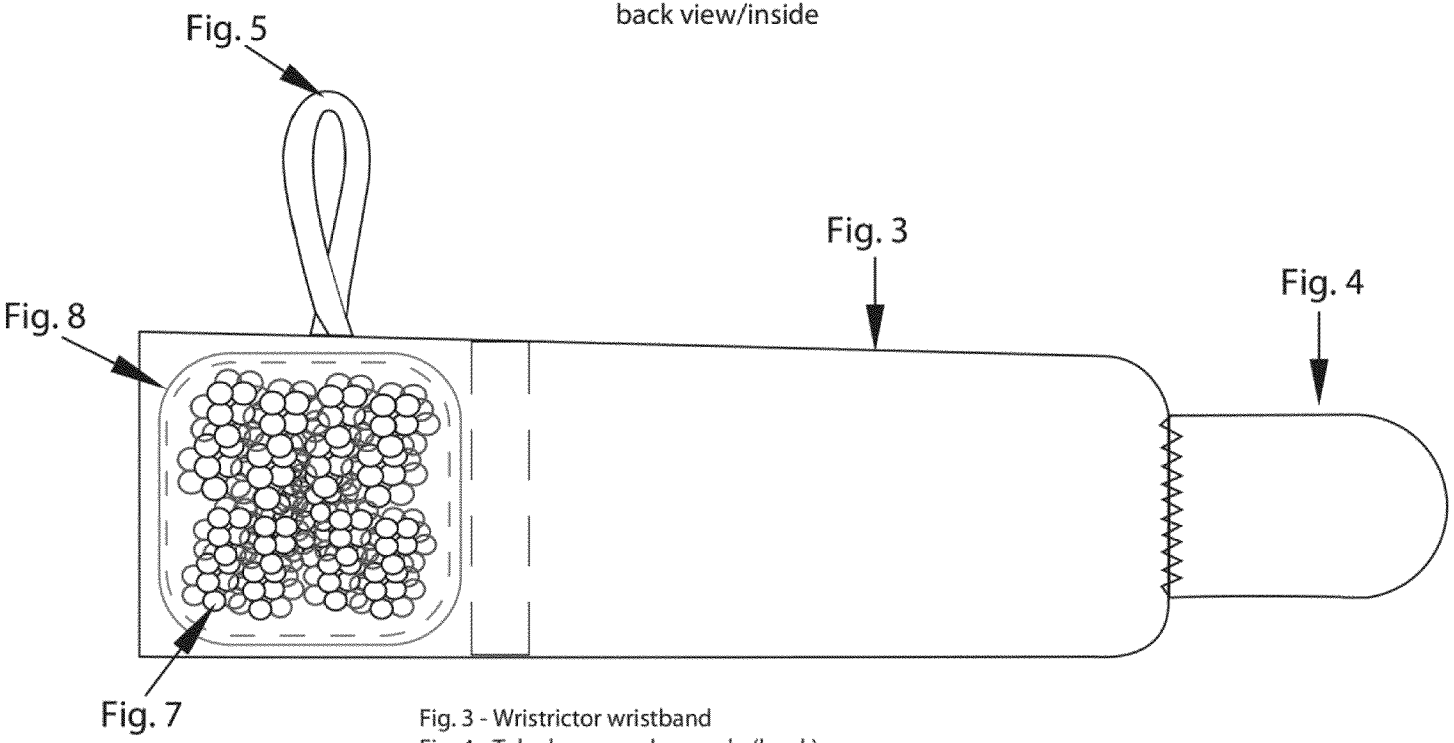
FIG. 2 is a rear schematic view, partially in section, thereof.
Figure 3A:
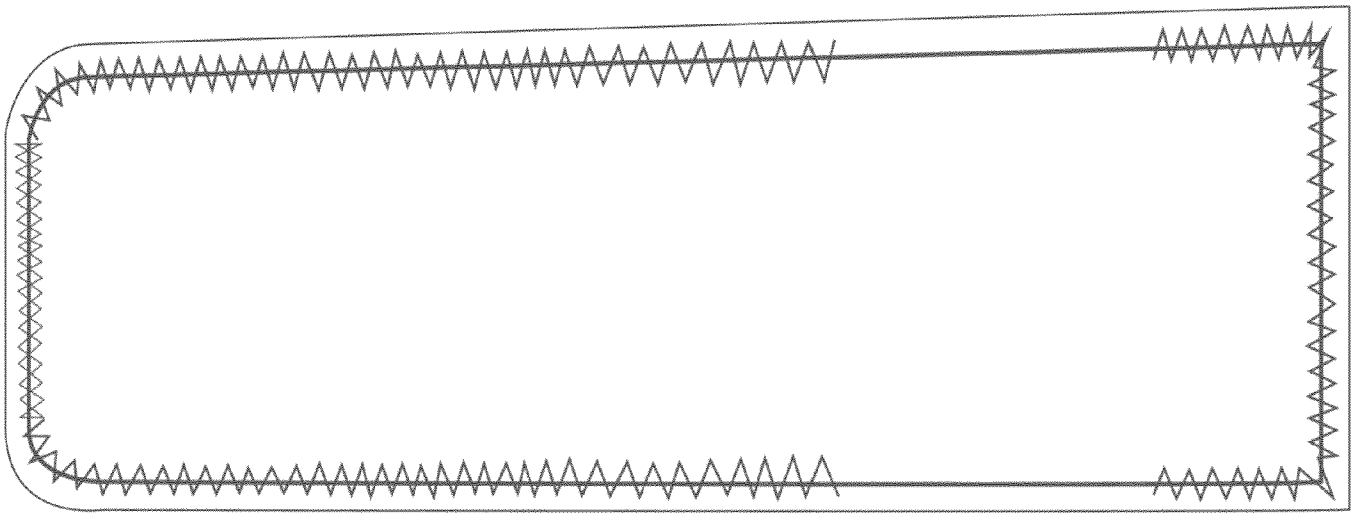
FIG. 3A is a front schematic view of a wristband thereof, now without text.
Figure 4:
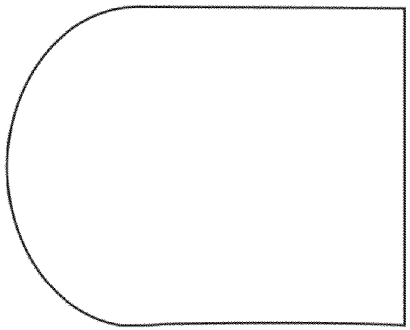
FIG. 4 is a front schematic view of a tab fastener male hook portion thereof.
Figure 4A:
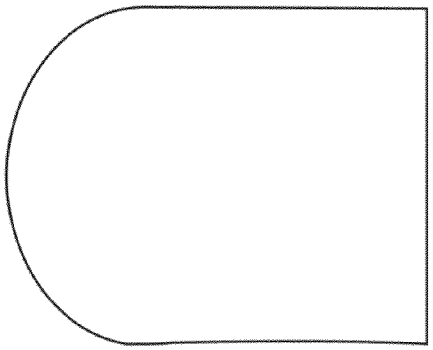
FIG. 4A is a front schematic view of a tab fastener male hook portion thereof, now without text.
Figure 5A:
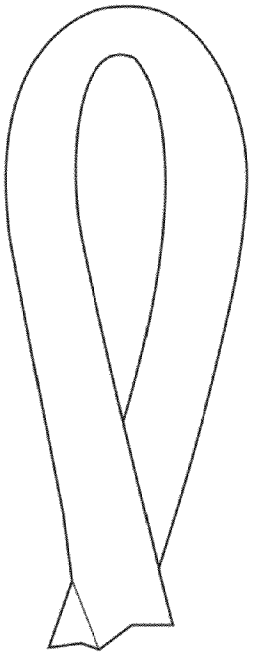
FIG. 5A is a front schematic view of a thumb strap thereof, now without text.
Figure 6A:
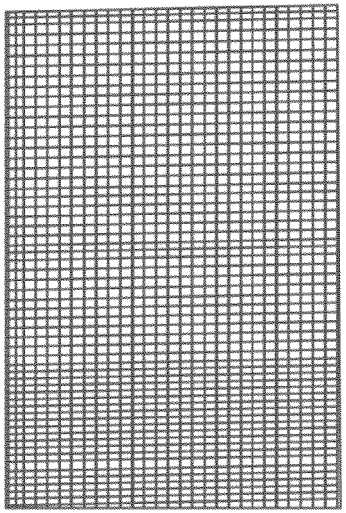
FIG. 6A is a front schematic view of a tab fastener female loop portion thereof, now without text.
Figure 7A:
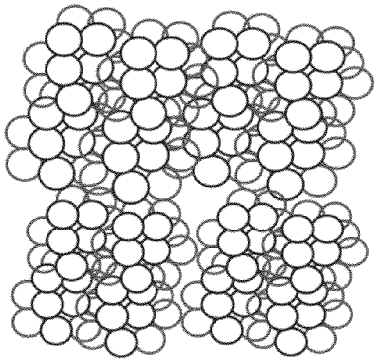
FIG. 7A is a schematic view of polypropylene beads thereof, now without text.
Figure 8A:
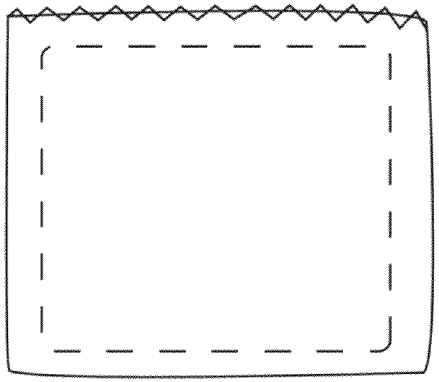
FIG. 8A is a schematic view of a bead bag thereof, now without text.
Figure 10:
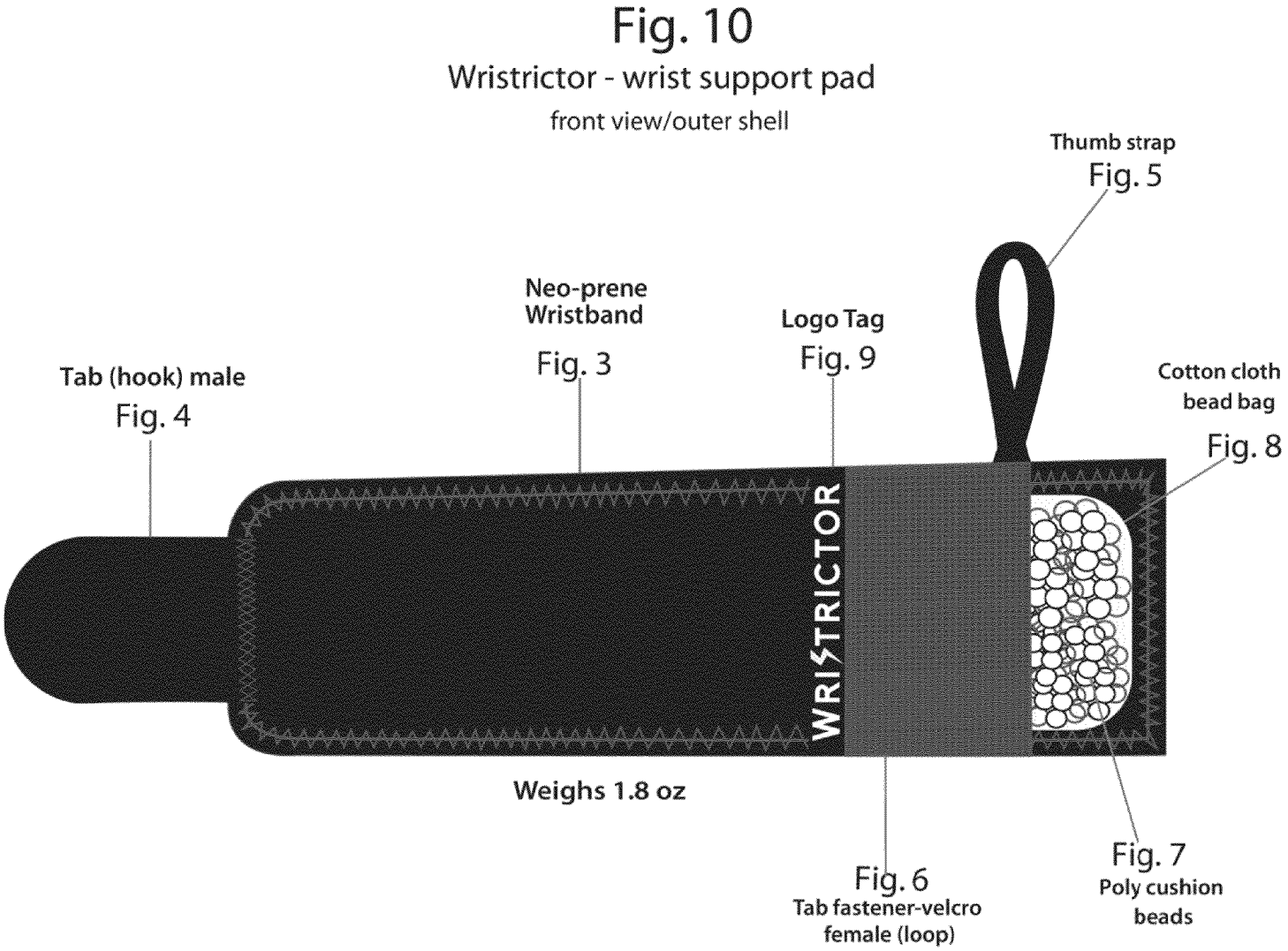
FIG. 10 is a front schematic view, partially in section, of an alternative exemplary embodiment of the Wrist support invention.
Figure 10A:
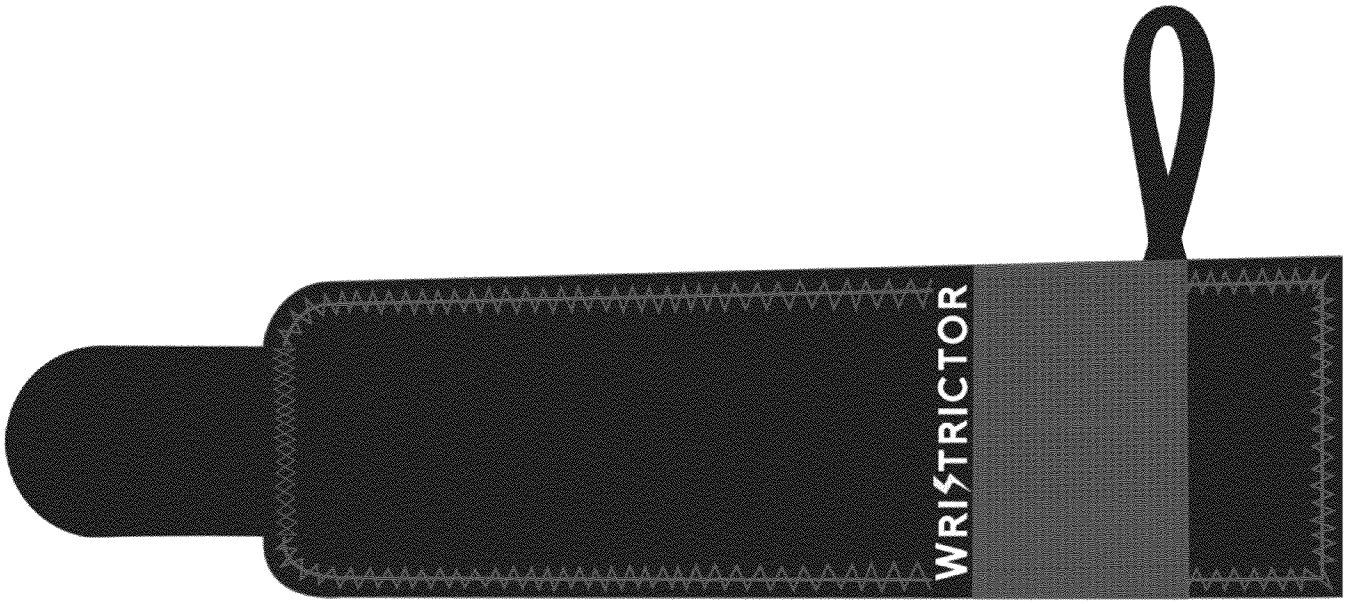
FIG. 10A is a front schematic view, partially in section, thereof, now without text.
Figure 11A:
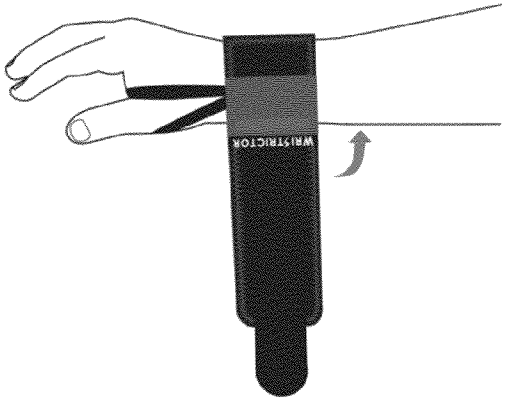
FIG. 11A is side schematic view of an exemplary embodiment of the Wrist support invention as shown in FIG. 11 in a first operational state, now without text.
Figure 12A:
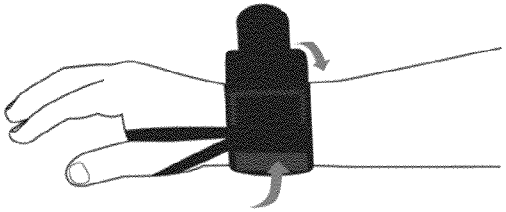
FIG. 12A is a side schematic view thereof in a second operational state.
Figure 13A:
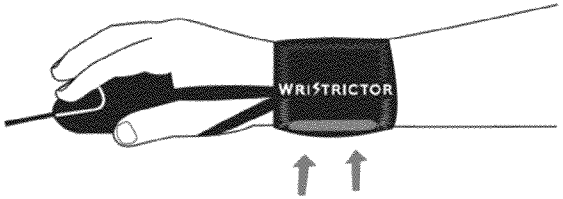
FIG. 13A is a side schematic view thereof in a third operational state.

While I have shown and described only two embodiments in accordance with the present invention it is understood that the same is not limited thereto but is susceptible of numerous changes and modifications as known to those skilled in the art, and I therefore do not wish to be limited to the details shown and described herein, but intend to cover all such changes and modifications as are encompassed by the scope of the appended claims.

DETAILED DESCRIPTION OF AN ENABLING AND PREFERRED EMBODIMENT

The illustrations and examples provided herein are for explanatory purposes and are not intended to limit the scope of the appended claims, as those skilled in the art will make modifications to the invention for particular uses.

What is claimed is:

1. A wrist support apparatus for wearable support and comfort for a wrist of a wearer, comprising:

a wristband configured for removable engagement about the wrist of the wearer;

cushion beads incorporated within the wristband and configured so as to be positioned substantially beneath the wrist of the wearer when the wrist support apparatus is worn, wherein the cushion beads are contained within a removable fabric bead bag that is inserted within the wristband; and a thumb strap formed as a single loop attached to the wristband so as to extend substantially perpendicularly from a lengthwise side of the wristband and configured for looping about the thumb of the wearer when the wrist support apparatus is worn, whereby the thumb strap serves to locate the wristband circumferentially about the wrist so as to properly position the cushion beads and to further locate the wristband axially so as to help maintain the position of the wristband during use of the wrist support apparatus.

2. The apparatus of claim 1 wherein the wristband is approximately eight inches long and approximately three inches wide (8 in.×3 in.).

3. The apparatus of claim 2 wherein the wristband is made of neoprene.

4. The apparatus of claim 1 further comprising a means for securing the wristband about the wrist of the wearer.

5. The apparatus of claim 4 wherein the securing means comprises a hook and loop fastener.

6. The apparatus of claim 1 wherein the cushion beads are polyurethane.

7. The apparatus of claim 6 wherein the gross weight of cushion beads within the apparatus is in the range of approximately seven to eight ounces (7-8 oz.).

8. The apparatus of claim 1 wherein the thumb strap is attached to the wristband at a substantially singular point and is configured as a unitary loop approximately two-and-a-half inches long and one-and-a-half inches wide (2.5 in.×1.5 in.).

9. The apparatus of claim 8 wherein the thumb strap is formed of a substantially elastic material.

10. A wrist support apparatus for wearable support and comfort for a wrist of a wearer, comprising:

a wristband configured for removable engagement about the wrist of the wearer;

a removable fabric bead bag containing polyurethane cushion beads inserted within the wristband, the beads and bead bag configured so as to be positioned substantially beneath the wrist of the wearer when the wrist support apparatus is worn;

a hook and loop fastener incorporated into the wristband to cooperate in securing the wristband about the wrist of the wearer; and a thumb strap formed as a single loop attached to a lengthwise side of the wristband and configured for looping about the thumb of the wearer when the wrist support apparatus is worn, the thumb strap being formed of a substantially elastic material, whereby the thumb strap serves to locate the wristband circumferentially about the wrist so as to properly position the cushion beads and to further locate the wristband axially so as to help maintain the position of the wristband during use of the wrist support apparatus.

* * * * *